US011452420B2

(12) United States Patent
Hwang et al.

(10) Patent No.: US 11,452,420 B2
(45) Date of Patent: Sep. 27, 2022

(54) CLEANER

(71) Applicant: LG ELECTRONICS INC., Seoul (KR)

(72) Inventors: Jungbae Hwang, Seoul (KR); Sangyoung Song, Seoul (KR); Taekgi Lee, Seoul (KR); Jinrae Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/965,654

(22) PCT Filed: Dec. 31, 2018

(86) PCT No.: PCT/KR2018/016972
§ 371 (c)(1),
(2) Date: Jul. 29, 2020

(87) PCT Pub. No.: WO2019/146922
PCT Pub. Date: Aug. 1, 2019

(65) Prior Publication Data

US 2021/0038035 A1 Feb. 11, 2021

(30) Foreign Application Priority Data

Jan. 29, 2018 (KR) ..... 10-2018-0010953

(51) Int. Cl.
*A47L 9/16* (2006.01)
*A47L 5/24* (2006.01)

(52) U.S. Cl.
CPC ..... *A47L 9/165* (2013.01); *A47L 5/24* (2013.01)

(58) Field of Classification Search
CPC ... A47L 9/165; A47L 5/24; A47L 9/02; A47L 9/248; A47L 9/16; A47L 5/28;
(Continued)

(56) References Cited

U.S. PATENT DOCUMENTS 2,064,587 A * 12/1936 Carlstedt ..... A47L 9/0072 55/367
9,314,139 B2 * 4/2016 Conrad ..... A47L 9/0477
(Continued)

FOREIGN PATENT DOCUMENTS

CN 107105951 A 8/2017
DE 102012100041 A1 7/2013
(Continued)

OTHER PUBLICATIONS

KR-20060117000-A translation Espacenet (Year: 2021).*
(Continued)

*Primary Examiner* — Joseph J Hail
*Assistant Examiner* — Timothy Brady
(74) *Attorney, Agent, or Firm* — Birch, Stewart, Kolasch & Birch, LLP

(57) ABSTRACT

A cleaner includes: a main body for separating dust from air suctioned through an opening; a suction motor generating suction force; and a suction part coupled to the opening part and having a connection pipe for guiding the air to the main body. The main body includes a suction guide coupled to one side of the connection pipe including a guide duct having a rotatable flap provided thereto. The suction guide is connected to the guide duct. A suction duct includes: a first surface, where the flap is installed; and a second surface facing the first surface. A second extension line of the second surface forms a first angle with a first extension line of one surface, of the suction guide, connected to the second surface. The first extension line and a third extension line of the flap form a second angle equivalent to or smaller than the first angle.

16 Claims, 10 Drawing Sheets

(58) Field of Classification Search
CPC ..... B01D 45/08; B01D 45/16; B01D 50/002; B01D 50/004; B01D 50/008
USPC ..... 15/353, 347, 322, 414, 415.1; 55/345–349, 391, 427, 462–465
See application file for complete search history.

(56) References Cited

U.S. PATENT DOCUMENTS

| | | | | |
|---|---|---|---|---|
| 9,451,858 | B2 * | 9/2016 | Stickney | A47L 9/1683 |
| 9,516,979 | B2 * | 12/2016 | Gidwell | A47L 5/26 |
| 2010/0325834 | A1 * | 12/2010 | Miefalk | B04C 5/04 15/347 |
| 2014/0137364 | A1 | 5/2014 | Stickney et al. | |
| 2017/0280950 | A1 | 10/2017 | Nam et al. | |
| 2017/0332860 | A1 | 11/2017 | Nam et al. | |
| 2020/0054183 | A1 * | 2/2020 | Buttery | A47L 9/122 |
| 2020/0054184 | A1 * | 2/2020 | Yang | A47L 5/24 |

FOREIGN PATENT DOCUMENTS

| | | | | |
|---|---|---|---|---|
| DE | 102012100047 | A1 | | 7/2013 |
| JP | 2887675 | B2 | | 4/1999 |
| JP | 2006-055379 | A | | 3/2006 |
| JP | 2015-173673 | A | | 10/2015 |
| KR | 10-2005-0043120 | A | | 5/2005 |
| KR | 20060117000 | A | * | 11/2006 |
| KR | 20090034952 | A | | 4/2009 |
| KR | 10-2016-0034041 | A | | 3/2016 |
| KR | 10-2006-0117000 | A | | 11/2016 |
| KR | 10-2017-0013419 | A | | 2/2017 |
| KR | 10-2017-0112853 | A | | 10/2017 |

OTHER PUBLICATIONS

Chinese Office Action issued by the State Intellectual Property Office (SIPO) of the People's Republic of China dated Apr. 22, 2021, in Chinese Application No. 201880087918.0 (6 pages).
Examination Report issued by the Australian Patent Office dated Apr. 23, 2020, in Australian Application No. 2018404657 (9 pages).

* cited by examiner

CLEANER

TECHNICAL FIELD

The present disclosure relates to a cleaner.

BACKGROUND

A cleaner is a device that performs cleaning by suctioning and wiping dust or foreign substances on a surface to be cleaned.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Korean Patent No. 10-1127088 (2012 Mar. 8) discloses a hand-held vacuum cleaner.

The hand-held vacuum cleaner includes a suction pipe, an airflow generator, a centrifugal separator, a power source, and a handle.

The airflow generator is located in a motor housing and has the form of a motor and fan assembly. A free motor filter is provided in the front of the airflow generator, and a post motor filter is provided in the rear of the airflow generator.

When a motor of the hand-held vacuum cleaner is driven, airflow is formed along the suction pipe, and air in an area to be cleaned may be suctioned through a suction port.

Foreign substances contained in the air suctioned through the suction port may be collected in an upstream cyclone by the centrifugal separator. In addition, air partially cleaned by the upstream cyclone may be introduced into a downstream cyclone. In the downstream cyclone, foreign substances with particles smaller than those collected in the upstream cyclone can be separated.

On the other hand, according to Korean Patent No. 10-1127088, the direction of the suction port through which air in the suction pipe is suctioned and the direction of the inlet connecting the suction pipe and the upstream cyclone do not coincide with each other, so that the flow path is bent inside the upstream cyclone. Since the flow direction of the air suctioned into the upstream cyclone changes due to the bending of the flow path, the suction performance may be deteriorated.

In addition, in the document, fluids flowing into the upstream cyclone may collide with each other due to the bending of the flow path inside the upstream cyclone. In this case, the fluids colliding with each other may block an inlet connecting the suction pipe and the upstream cyclone, thereby causing a problem of deteriorating suction performance of the cleaner.

SUMMARY

Technical Problem

The present disclosure provides a cleaner capable of improving suction performance without changing the external design of a cleaner.

The present disclosure provides a cleaner capable of reducing the phenomenon of clogging with foreign substances on a suction flow path.

Technical Solution

In accordance with an aspect, a cleaner includes a main body configured to separate dust from air suctioned through an opening; a suction motor provided in the main body to generate a suction force; and a suction inlet including a connection pipe coupled to the opening to guide air to the main body, wherein the main body includes a suction guide coupled to one side of the connection pipe to guide air suctioned through the connection pipe to an inner circumferential surface of the main body, and the connection pipe includes a guide duct on which a rotatable flap is installed.

The suction guide may be connected to the guide duct, and the suction duct may include a first surface on which the flap is installed, and a second surface facing the first surface.

A second extension line of the second surface may form a first angle with a first extension line of one surface of the suction guide connected to the second surface, a third extension line of the flap and the first extension line may form a second angle, and the second angle may be equal to or smaller than the first angle.

The main body may include a cyclone unit that separates dust from air using a cyclone flow, and the first extension line may extend in a tangential direction of the cyclone unit.

The second extension line may be parallel to the first extension line.

The first angle may be within a range of 0 degrees to 7 degrees.

A portion of the second surface close to one surface of the suction guide may be straight, and the other portion of the second surface may be rounded.

The cleaner may further include a guide member provided in the main body to guide air introduced through the opening.

The guide member may be positioned on the third extension line of the flap. The guide member may extend parallel to the third extension line of the flap.

The suction inlet may further include a pipe cover surrounding the connection pipe. The guide duct may include a rib positioned between the one surface of the suction guide and the pipe cover.

The rib may include a fixed rib protruding toward the pipe cover to contact the pipe cover.

The cleaner may further include an extension rib protruding from the second surface of the guide duct toward the pipe cover.

Advantageous Effects

According to this embodiment, there is an advantage that the flow loss of the flow path is reduced without changing the structure of the exterior of the cleaner.

In particular, the difference between the direction of the flow path of the suction pipe and the direction of the flow path of the cyclone unit may be reduced. Accordingly, the flow loss of the flow path is reduced, thus improving the suction performance of the cleaner.

In addition, the flap and the suction guide of the main body are arranged to be parallel to each other, reducing the bending of the flow path. Therefore, there is an advantage that the suction performance of the cleaner is improved.

In addition, it is possible to reduce a phenomenon in which a fluid rotating inside the cyclone unit collides with a fluid that is subsequent by a flow guide extending from an opening of the main body. Accordingly, a phenomenon in which foreign substances collide with each other within the cyclone unit may be reduced, so that a phenomenon of clogging with foreign substances may be reduced.

DETAILED DESCRIPTION

Figure 1:
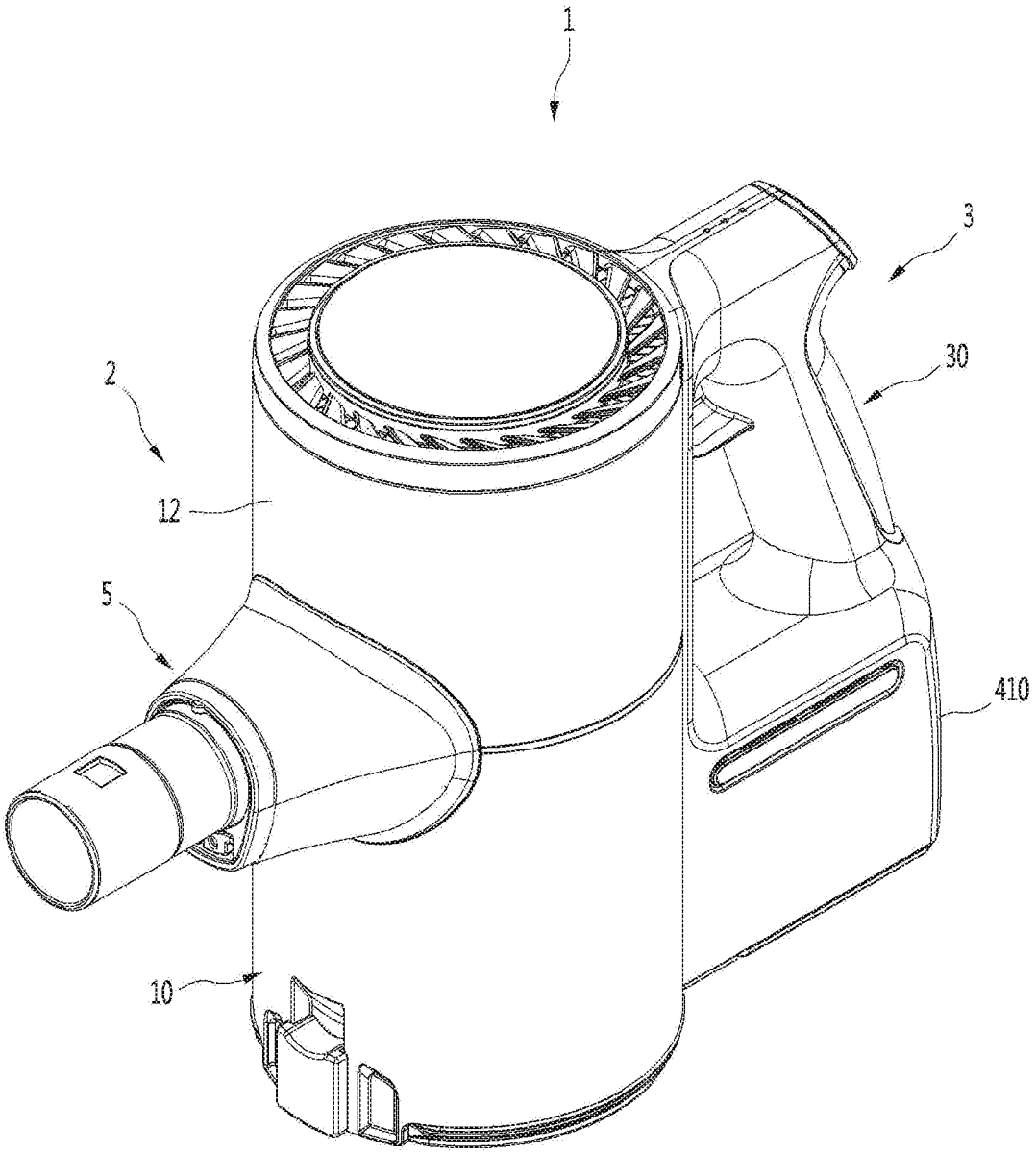
FIG. 1 is a perspective view of a cleaner according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Configuration of Cleaner

Figure 2:
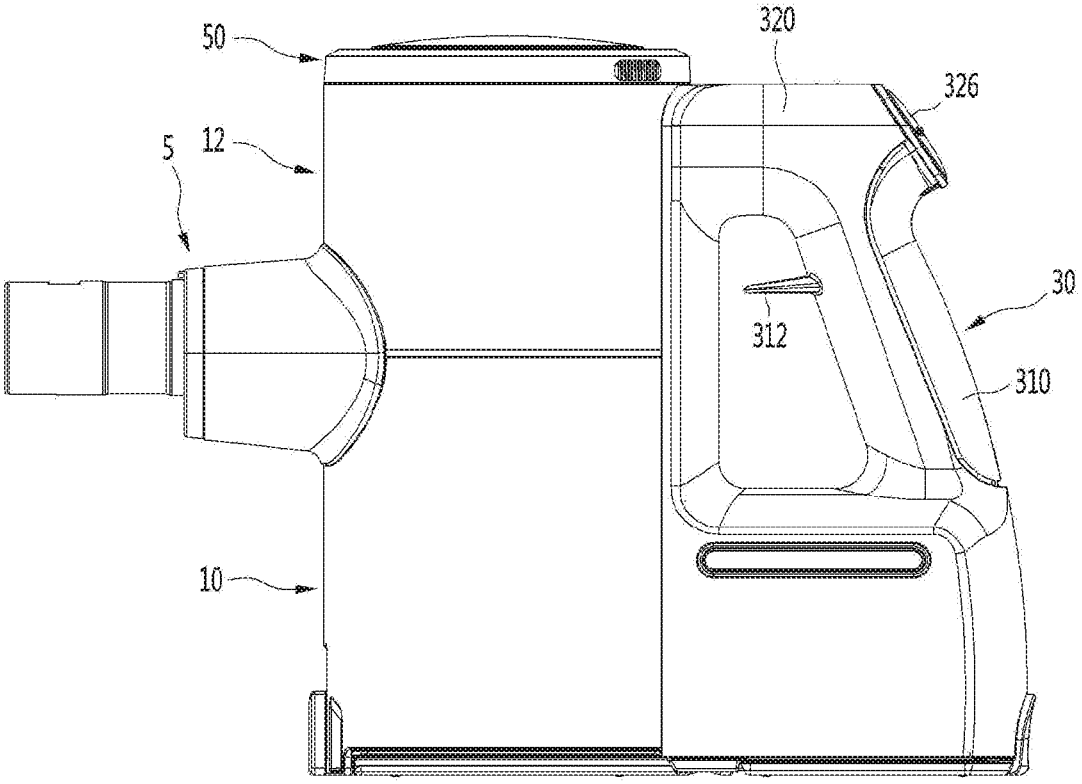
FIG. 2 is a side view of a cleaner according to an embodiment of the present disclosure.
Figure 3:
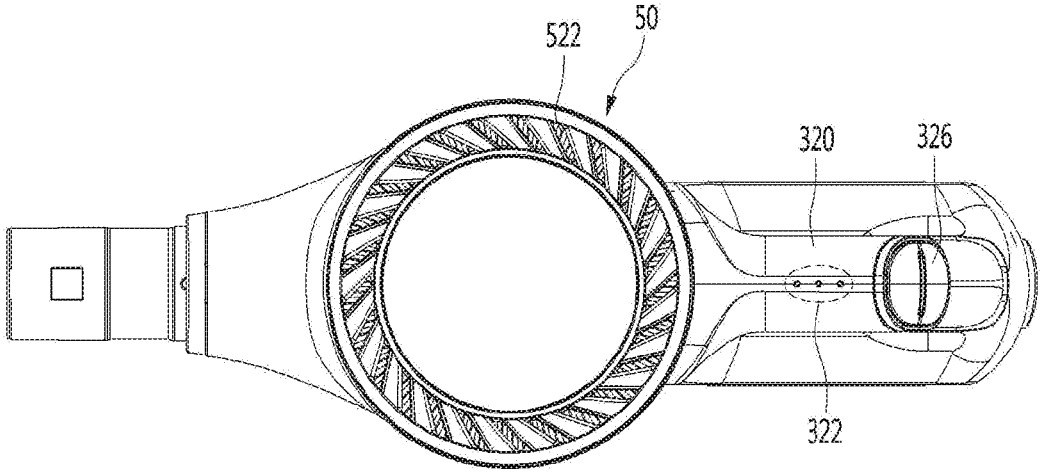
FIG. 3 is a plan view of a cleaner according to an embodiment of the present disclosure.
Figure 4:
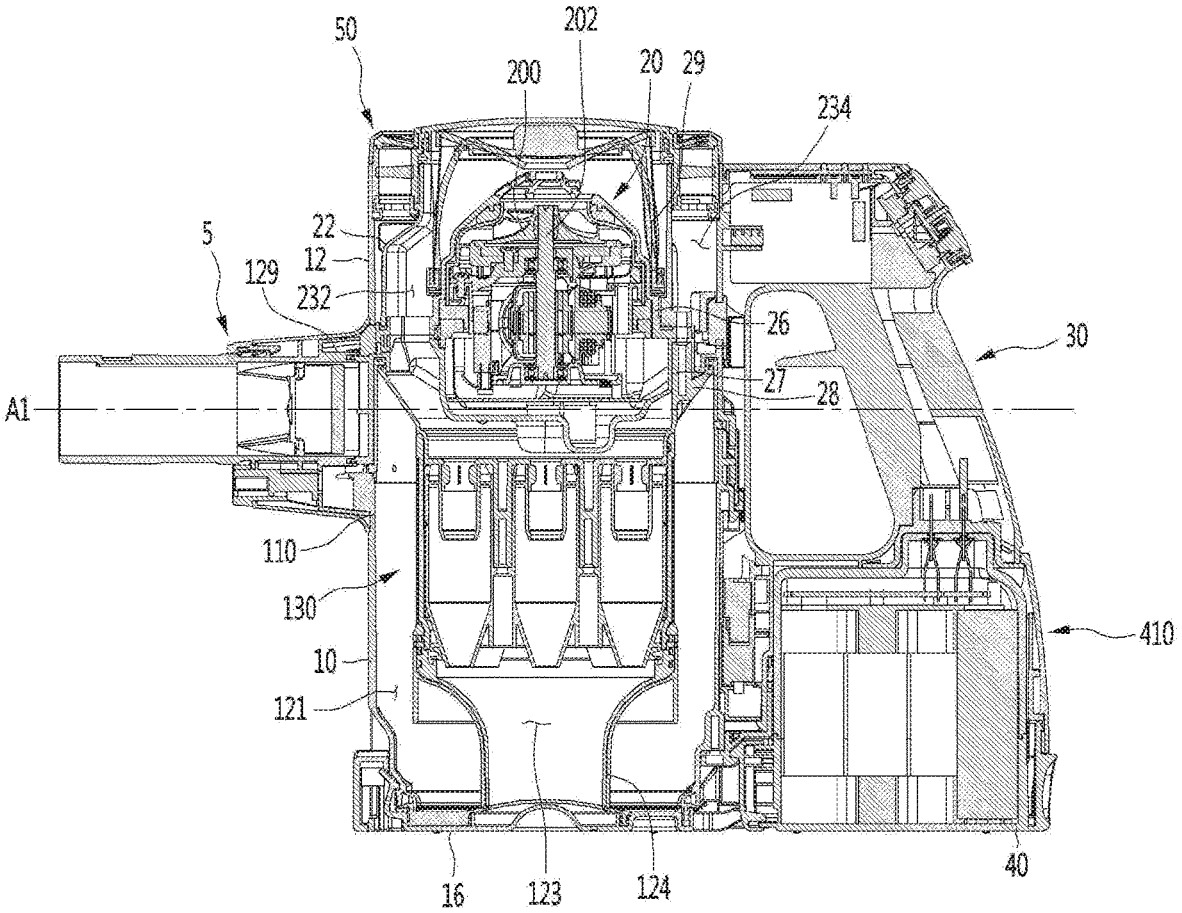
FIG. 4 is a longitudinal sectional view of a cleaner according to an embodiment of the present disclosure.

FIG. 1 is a perspective view of a cleaner according to an embodiment, FIG. 2 is a side view of the cleaner according to an embodiment. FIG. 3 is a plan view of the cleaner according to an embodiment, and FIG. 4 is a cross-sectional view of the cleaner according to an embodiment.

Referring to FIGS. 1 to 4, a cleaner 1 according to an embodiment may include a main body 2.

The cleaner 1 may further include a suction inlet 5 coupled to the front of the main body 2. The suction inlet 5 can guide air containing dust into the main body 2.

The cleaner 1 may further include a handle unit 3 coupled to the main body 2. The handle unit 3 may be positioned opposite to the suction inlet 5 on the main body 2.

The main body 2 may include a first body 10 and a second body 12 positioned at the upper side of the first body 10. The first body 10 and the second body 12 may be directly coupled to each other to form the appearance of the main body 2. Alternatively, the first body 10 and the second body 12 may be indirectly coupled to each other through an intermediate member to form the appearance of the main body 2.

The first body 10 and the second body 12 may be provided in a circular shape but are not limited thereto.

Each of the first body 10 and the second body 12 may have a shape in which upper and lower sides are opened. That is, each of the first body 10 and the second body 12 may include an upper opening and a lower opening.

The suction inlet 5 may be coupled to the main body 2 such that the center of the suction inlet 5 is positioned approximately at the boundary between the first body 10 and the second body 12.

The main body 2 may further include a dust separation unit that separates foreign substances from air suctioned through the suction inlet 5.

The dust separation unit may include a first cyclone unit 110 capable of separating foreign substances by a cyclone flow, for example. In other words, the first body 10 may include the first cyclone unit 110. Air and foreign substances suctioned through the suction inlet 5 may spirally flow along the inner circumferential surface of the first cyclone unit 110. The axis of the cyclone flow of the first cyclone unit 110 may extend in the vertical direction.

The dust separation unit may further include a second cyclone unit 130 that again separates foreign substances from the air discharged from the first cyclone unit 110. The second cyclone unit 130 may be located inside the first cyclone unit 110. Therefore, the size of the dust separation unit can be made smaller, so that a more compact appearance of the cleaner can be formed. The second cyclone unit 130 may include a plurality of cyclone bodies arranged in parallel.

As another example, it is possible that the dust separation unit has a single cyclone unit, and even in this case, the axis of the cyclone flow may extend in the vertical direction.

Meanwhile, the first body 10 may perform a storage function (or a dust bin function) for storing foreign substances separated from the cyclone units 110 and 130.

The main body 2 may further include a body cover 16 that opens and closes the lower side of the first body 10. The body cover 16 may open and close the first body 10 by a rotation operation.

At least a portion of the second cyclone unit 130 may be positioned in the first body 10.

A dust storage guide 124 for guiding the storage of foreign substances separated from the second cyclone unit 130 may be disposed in the first body 10. The dust storage guide 124 is coupled to the lower side of the second cyclone unit 130 and may contact the upper surface of the body cover 16.

The dust storage guide 124 may divide a space inside the first body 10 into a first dust storage unit 121 in which dust separated from the first cyclone unit 110 is stored and a second dust storage unit 123 in which the dust separated from the second cyclone unit 130 is stored.

The inner space of the dust storage guide 124 is the second dust storage unit 123, and the space between the dust storage guide 124 and the first body 10 is the first dust storage unit 121. The body cover 16 may open and close the first dust storage unit 121 and the second dust storage unit 123 together.

The cleaner 1 may further include a suction motor 20 for generating suction force and a battery 40 for supplying power to the suction motor 20. The suction motor 20 may be located in the second body 12. Further, at least a portion of the suction motor 20 may be positioned at the upper side of the dust separation unit. In other words, the suction motor 20 may be located above the first body 10.

The cleaner 1 may further include a discharge guide 28 connected to an outlet of the second cyclone unit 130 and a flow guide 22 communicating with the discharge guide 28.

For example, the discharge guide 28 may be positioned at the upper side of the second cyclone unit 130, and the flow guide 22 may be positioned at the upper side of the discharge guide 28. Further, at least a portion of the suction motor 20 may be located inside the flow guide 22. Accordingly, the axis of the cyclone flow of the dust separation unit may pass through the suction motor 20.

As the suction motor 20 is positioned at the upper side of the second cyclone unit 130, air discharged from the second cyclone unit 130 may flow directly to the suction motor 20. Therefore, a flow path between the dust separation unit and the suction motor 20 may be minimized.

The suction motor 20 may include an impeller 200 that rotates. The impeller 200 may be connected to the shaft 202. The shaft 202 may be disposed to extend in the vertical direction (the up-down direction of FIG. 3).

An extension line of the shaft 202 (also referred to as a rotation axis of the impeller 200) may pass through the first body 10. In this case, the rotation axis of the impeller 200 and the axis of the cyclone flow generated in the first cyclone unit 110 of the dust separation unit may be located on the same line.

According to the present embodiment, a path through which the air discharged from the dust separation unit, that is, the air discharged upward from the second cyclone unit 130 flows toward the suction motor 20 is reduced, thereby reducing a change in the direction of air. Therefore, there is an advantage that the flow loss of air is reduced. When the flow loss of the air is reduced, the suction force may be increased. In addition, the use time of the battery 40 that supplies power to the suction motor 20 may increase.

The cleaner 1 may further include a motor housing accommodating the suction motor 20. The motor housing may further include an upper motor housing 26 covering a portion of an upper side of the suction motor 20 and a lower motor housing 27 covering a portion of a lower side of the suction motor 20. The suction motor 20 may be accommodated in each of the motor housings 26 and 27, and the flow guide 22 may be disposed to surround the upper motor housing 26.

At least a portion of the flow guide 22 may be spaced apart from the upper motor housing 26. In addition, at least a portion of the flow guide 22 may be spaced apart from the second body 12. Accordingly, the inner circumferential surface of the flow guide 22 and the outer circumferential surface of the upper motor housing 26 form a first air flow path 232, the outer circumferential surface of the flow guide 22 and the inner circumferential surface of the second body 12 form a second air flow path 234.

The air discharged from the second cyclone unit 130 flows to the suction motor 20 along the first air flow path 232, and the air discharged from the suction motor 20 flows along the second air flow path 234 and is then discharged to the outside. Therefore, the second air flow path 234 functions as a discharge flow path.

The handle unit 3 may include a handle 30 for gripping by a user and a battery housing 410 disposed at the lower side of the handle 30. The handle 30 may be disposed behind the suction motor 20.

When defining directions, in the cleaner 10, the direction in which the suction inlet 5 is positioned based on the suction motor 20 is a forward direction, and the direction in which the handle 30 is located is a rearward direction.

The battery 40 may be disposed behind the first body 10. Therefore, the suction motor 20 and the battery 40 are disposed so as not to overlap in the vertical direction, and may also be arranged at different arrangement heights. According to the present disclosure, based on the handle 30, the suction motor 20 that is heavy is located in the front of the handle 30, the battery 40 that is heavy is located at the lower side of the handle 30 so that the overall weight of the cleaner 1 is evenly distributed. Therefore, when the user performs cleaning in the state of gripping the handle 30, the load applied to the user's wrist can be reduced. That is, since the heavy components are arranged at the front and rear of the cleaner 1 and at different heights in a distributed manner, the center of gravity of the cleaner 1 can be prevented from being biased to either side.

Since the battery 40 is located below the handle 30 and the suction motor 20 is located in front of the handle 30, no configuration exists above the handle 30. That is, the upper surface of the handle 30 forms a partial appearance of the upper surface of the cleaner 10. Therefore, in the process of gripping and using, by the user, the handle 30, one configuration of the cleaner 1 can be prevented from contacting the user's arm.

The handle 30 extends in the vertical direction, and may include a first extension 310 that can be held by a user and a second extension 320 extending from the upper side of the first extension 310 toward the suction motor 20. At least a portion of the second extension 320 may extend in a horizontal direction.

In the first extension 310, when the user grips the first extension 310, a movement limiting portion 312 may be provided to prevent the user's hand from moving in the longitudinal direction of the first extension 310 (the up-down direction of FIG. 2). The movement limiting portion 312 may extend from the first extension 310 toward the suction inlet 5.

The movement limiting portion 312 is disposed spaced apart from the second extension 320. Accordingly, in the state where the first extension 3109 is gripped, some fingers are positioned above the movement limiting portion 312 and the rest of the fingers are positioned below the movement limiting portion 312. For example, the movement limiting portion 312 may be positioned between the index finger and the middle finger.

According to such an arrangement, the longitudinal axis A1 of the suction inlet 5 may pass through the user's wrist in a state where the user grips the first extension 310. When the longitudinal axis A1 of the suction inlet 5 passes through the user's wrist, the longitudinal axis A1 of the suction inlet 5 is arranged substantially parallel to the extending direction of the user's arm in the state where the user's arm is extended. Therefore, in such a state, when the user pushes or pulls the vacuum cleaner 1 while holding the handle 30, there is an advantage that a required user's force is minimized.

The handle 30 may include an operation unit 326. In one example, the operation unit 326 may be located on an inclined surface formed in the second extension 320. The on command and off command of the cleaner (suction motor) may be input through the operation unit 326. The operation unit 326 may be arranged to face the user. The operation unit 326 may be located on the opposite side of the movement limiting portion 312 based on the handle 30. The operation unit 326 is also positioned at a portion higher than the movement limiting portion 312 based on the handle 30.

Therefore, the user can easily operate the operation unit 326 with the thumb while holding the first extension 310.

In addition, since the operation unit 326 is positioned at a position away from the first extension 310, it is possible to prevent the operation unit 326 from operating differently from a user's intention when performing cleaning in a state where the first extension 310 is gripped.

The second extension 320 may be provided with a display unit 322 for displaying an operating state. As an example of the display unit 322, it is possible to easily identify the display unit 322 located on the upper surface of the second extension 320. The display unit 322 may display, for example, the remaining amount of the battery 40, the strength of the suction motor, and the like.

The display unit 322 is not limited, but may include a plurality of light emitting devices. The plurality of light emitting devices may be arranged spaced apart in the longitudinal direction of the second extension 320. The battery housing 410 may be positioned at the lower side of the first extension 310. In one example, the battery 40 may be inserted into the battery housing 410 from the lower side of the battery housing 410.

The rear surface of the battery housing 410 and the rear surface of the first extension 310 may form a continuous surface. Therefore, the battery housing 410 and the first extension 310 may have a sense of unity.

Filter Configuration of Vacuum Cleaner

Figure 5:
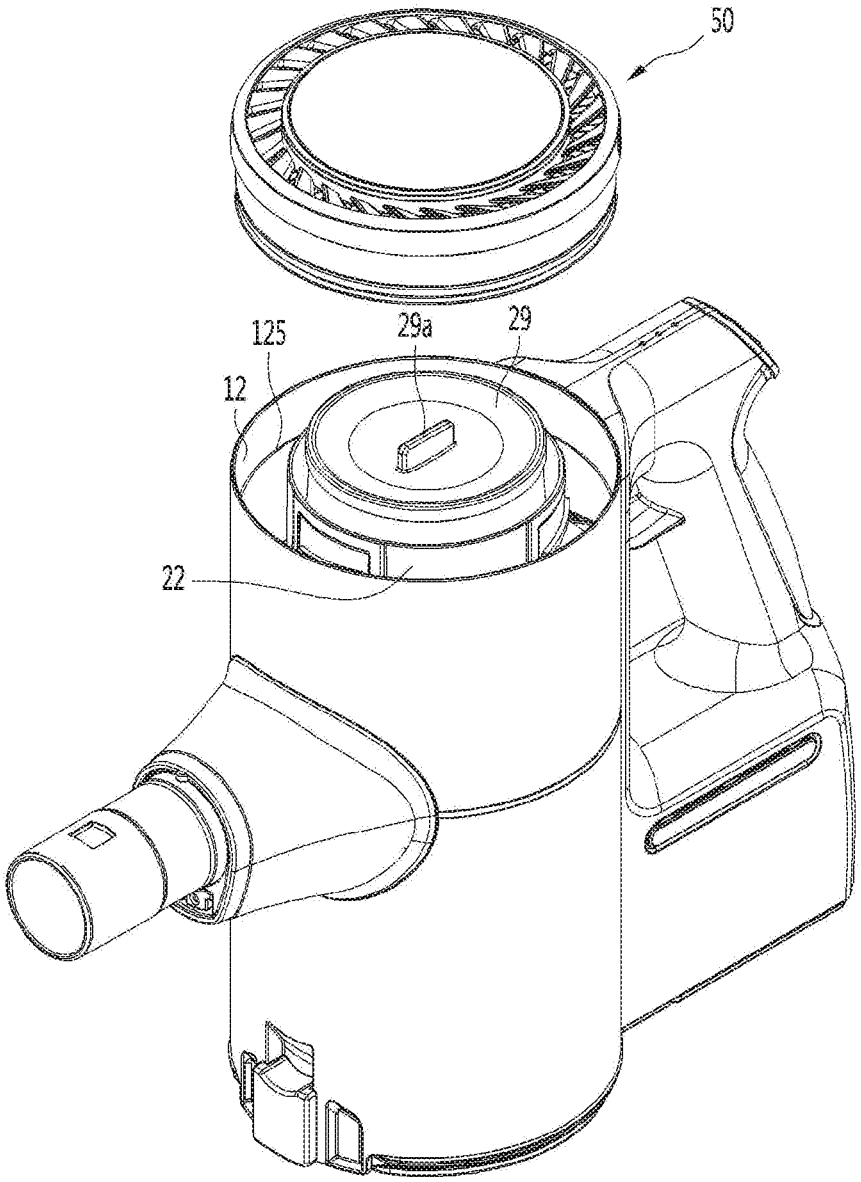
FIG. 5 is a view showing a state in which an opening cover according to an embodiment of the present disclosure is separated from a main body.

FIG. 5 is a view showing a filter mechanism according to an embodiment of the present disclosure, which is separated from a main body.

Referring to FIG. 5, the cleaner 1 may further include a filter mechanism 50 having an air outlet through which air passing through the suction motor 20 is discharged. The filter mechanism 50 may be detachably coupled to the upper side of the main body 2.

The filter mechanism 50 may be detachably coupled to the second body 12 as an example.

In a state in which the filter mechanism 50 is coupled to the second body 12, a portion of the filter mechanism 50 is located outside the second body 12. Accordingly, a portion of the filter mechanism 50 is introduced into the main body 2 through the upper opening of the main body 2, and the other portion protrudes out of the main body 2.

The height of the main body 2 may be substantially the same as the height of the handle 30. Therefore, the filter mechanism 50 protrudes upward of the main body 2, so that the user can easily separate the filter mechanism 50 from the main body 2 while the user holds the filter mechanism 50.

An air outlet may be located at the upper side of the filter mechanism 50. Therefore, the air discharged from the suction motor 20 may be discharged into the upper side of the main body 2. Therefore, it is possible to prevent the air discharged from the air outlet from flowing toward the user.

The main body 2 may further include a pre-filter 29 for filtering air discharged from the suction motor 20. The pre-filter 29 may be exposed to the outside when the filter mechanism 50 is separated from the main body 2.

The pre-filter 29 may be disposed in the flow guide 22 as an example. That is, the flow guide 22 may have the function of a filter accommodating portion in which the pre-filter 29 is accommodated. The pre-filter 29 is seated on the upper motor housing 26 and may surround a portion of the upper motor housing 26. That is, the upper motor housing 26 may include a filter support (not shown) for supporting the pre-filter 29.

When the suction motor 20 is driven, air discharged from the first and second cyclone units 110 and 130 passes through a first air flow path formed on the inner circumferential surface of the flow guide 22 and the outer circumferential surface of the upper motor housing 26 and a second air flow path 234 formed on the outer circumferential surface of the flow guide 22 and the inner circumferential surface of the second body 12, and is then discharged to the outside. In this case, the air flowing through the first air flow path 232 may be primarily filtered by the pre-filter 29. In addition, the air that has passed through the pre-filter 29 may be secondary filtered by the filter mechanism 50 while flowing to the second air flow path 234.

The filter mechanism 50 may be formed in a substantially cylindrical shape. The air outlet including a plurality of openings may be formed in the upper side of the filter mechanism 50. The plurality of openings of the air outlet may be arranged in the circumferential direction of the filter mechanism 50.

The filter mechanism 50 may include an exhaust filter for filtering out foreign substances contained in air to be exhausted to the outside. The exhaust filter is, for example, a high efficiency particulate air (HEPA) filter. In the state where the filter mechanism 50 is coupled to the main body 2, the exhaust filter may be arranged to surround the flow guide 22 to prevent the height of the cleaner 1 from increasing. In other words, the exhaust filter may be formed in a ring shape as an example, and at least a portion of the flow guide 22 may be positioned in an area formed by the exhaust filter.

When the exhaust filter and the pre-filter 29 are positioned in the second body 12, at least a portion of the pre-filter 29 is accommodated in the area formed by the exhaust filter so as to prevent an increase in height. That is, the exhaust filter may surround the pre-filter 29.

The axis of the cyclone flow of the first cyclone unit 110 may pass through the exhaust filter and the filter mechanism 50. In one example, the axis of the cyclone flow may pass through the area formed by the exhaust filter. That is, the axis of the cyclone flow of the first cyclone unit 110 may pass through the central opening of the exhaust filter with a ring shape.

Detailed Configuration of Filter Mechanism

Figure 6:
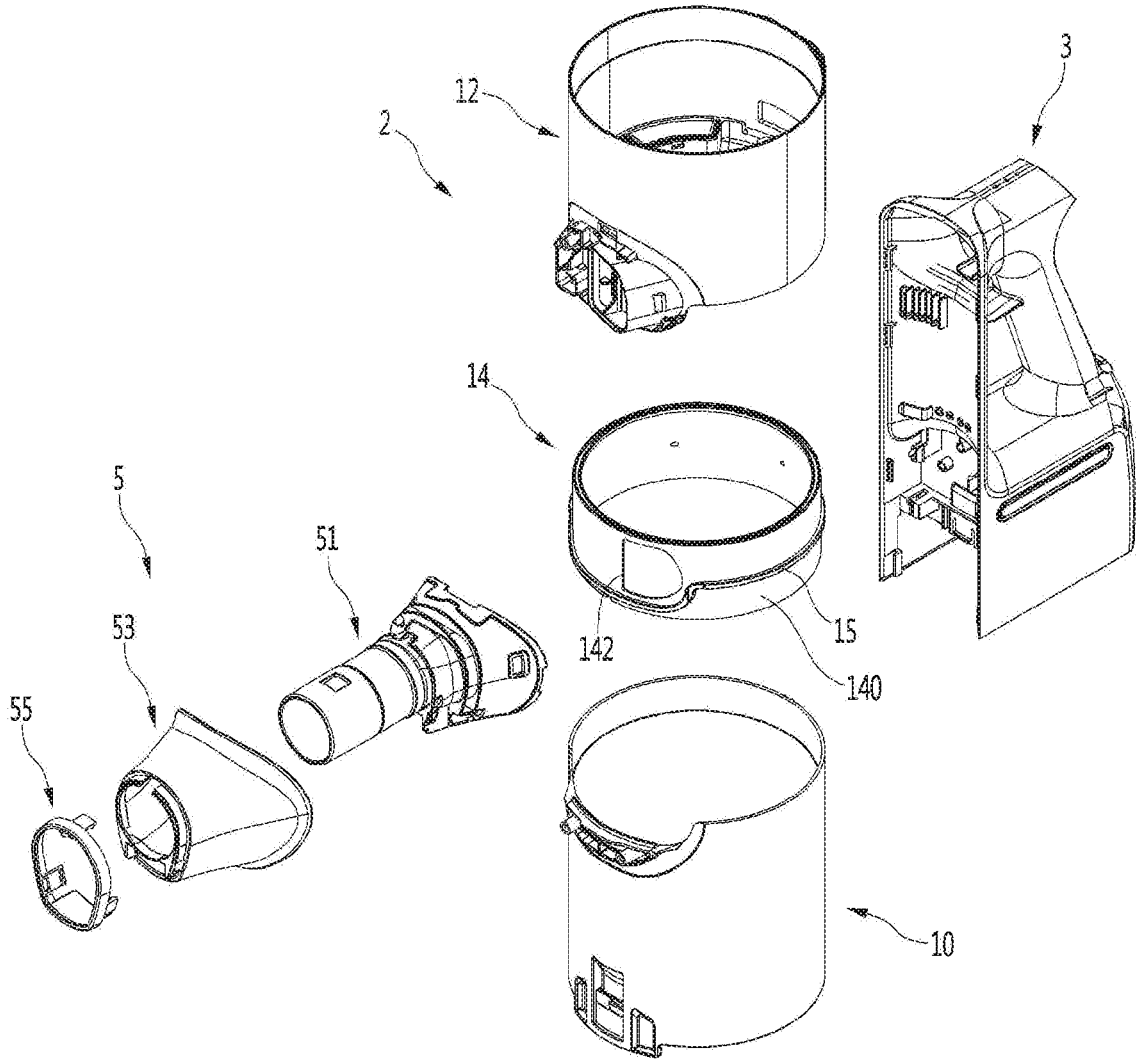
FIG. 6 is an exploded perspective view of a cleaner according to an embodiment of the present disclosure.

Referring to FIGS. 4 to 6, the pre-filter 29 may be provided in a cylindrical shape, for example.

The pre-filter 29 may be provided with a gripping portion 29*a* protruding upward. The user grasps the gripping portion 29*a* of the pre-filter 29 exposed to the outside and lifts the pre-filter 29 upward, so that the user can separates the pre-filter 29 from the main body 2. Since the pre-filter 29 can be separated from the main body 2, the user can easily clean the pre-filter 29.

The pre-filter 29 may be provided in a substantially cylindrical shape. The air in the first air flow path may pass through the pre-filter 29. Further, the foreign substances contained in the air may be filtered out by the pre-filter (29). The pre-filter 29 may be a mesh filter having a cylindrical shape.

Detailed Configuration of Suction Inlet and Main Body of Vacuum Cleaner

FIG. 6 is an exploded perspective view of a cleaner according to an embodiment of the present disclosure.

Referring to FIG. 6, the main body 2 may be disposed between the suction inlet 5 and the handle unit 3. In addition, the first body 10 and the second body 12 may be arranged in the vertical direction.

The cleaner 1 may further include a sealing member 15 and a support body 14 supporting the sealing member 15 for sealing a boundary portion between the first body 10 and the second body 12 in a state where the first body 10 and the second body 12 are coupled to each other.

The support body 14 may be formed in a cylindrical shape. In this case, the outer diameter of the support body 14 may be formed equal to or smaller than the inner diameter of the first body 10 such that the support body 14 may be inserted into the first body 10 through the upper opening of the first body 10.

In addition, the outer diameter of the support body 14 may be formed equal to or smaller than the inner diameter of the second body 12 such that the support body 14 may be inserted into the second body 12 through the lower opening of the second body 12.

The support body 14 may include an opening 142 through which air passes.

The sealing member 15 may be coupled with the support body 14 to surround the outer circumferential surface of the support body 14. For example, the sealing member 15 may be integrally formed with the support body 14 by insert injection. Alternatively, the sealing member 15 may be coupled to the outer circumferential surface of the support body 14 by an adhesive.

A portion of the sealing member 15 may protrude from the support body 14. Although the support body 14 is inserted into the first body 10 and the second body 12 as the sealing member 15 protrudes from the support body 14 while surrounding the support body 14, the sealing member 15 may be located at the boundary portion between the first body 10 and the second body 12, thus enabling sealing.

The suction inlet 5 may include a connection pipe 51 connected to the main body 2, a pipe cover 53 surrounding the connection pipe 51, and a cover deco member 55 surrounding a portion of the pipe cover 53 and coupled to the connection pipe 51.

Detailed Configuration of Suction Inlet of Cleaner

Figure 7:
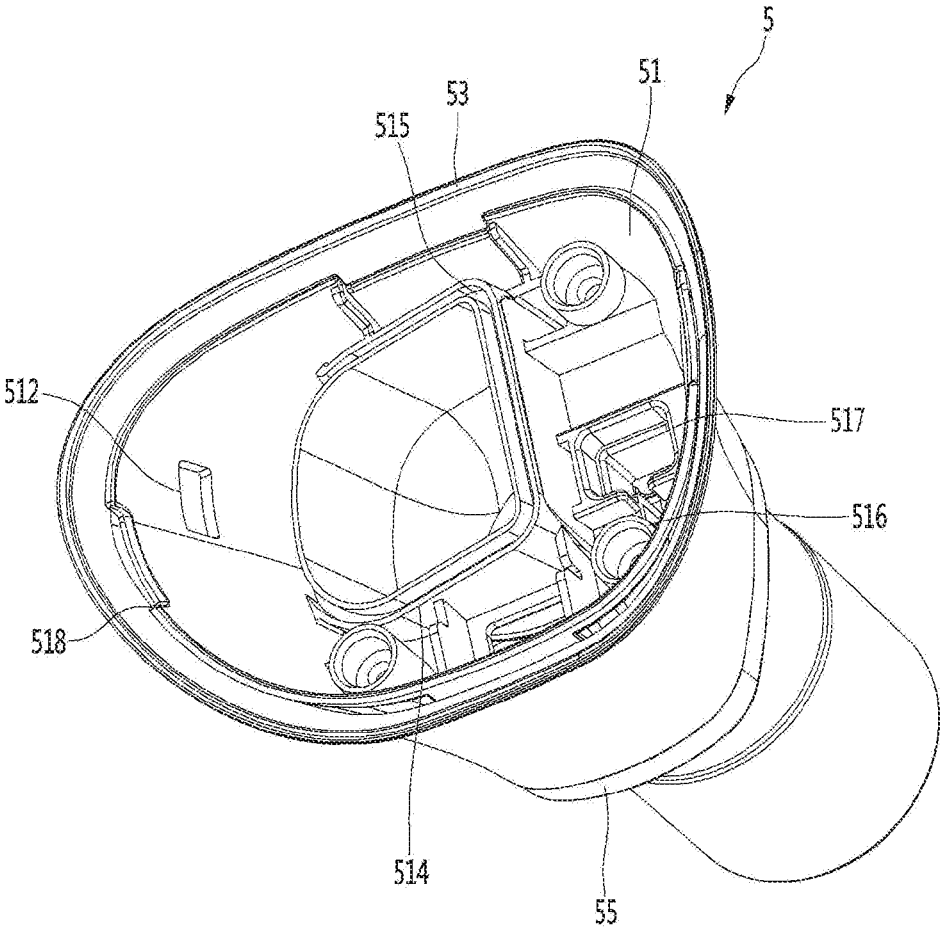
FIG. 7 is a perspective view of a suction inlet according to an embodiment of the present disclosure.
Figure 8:
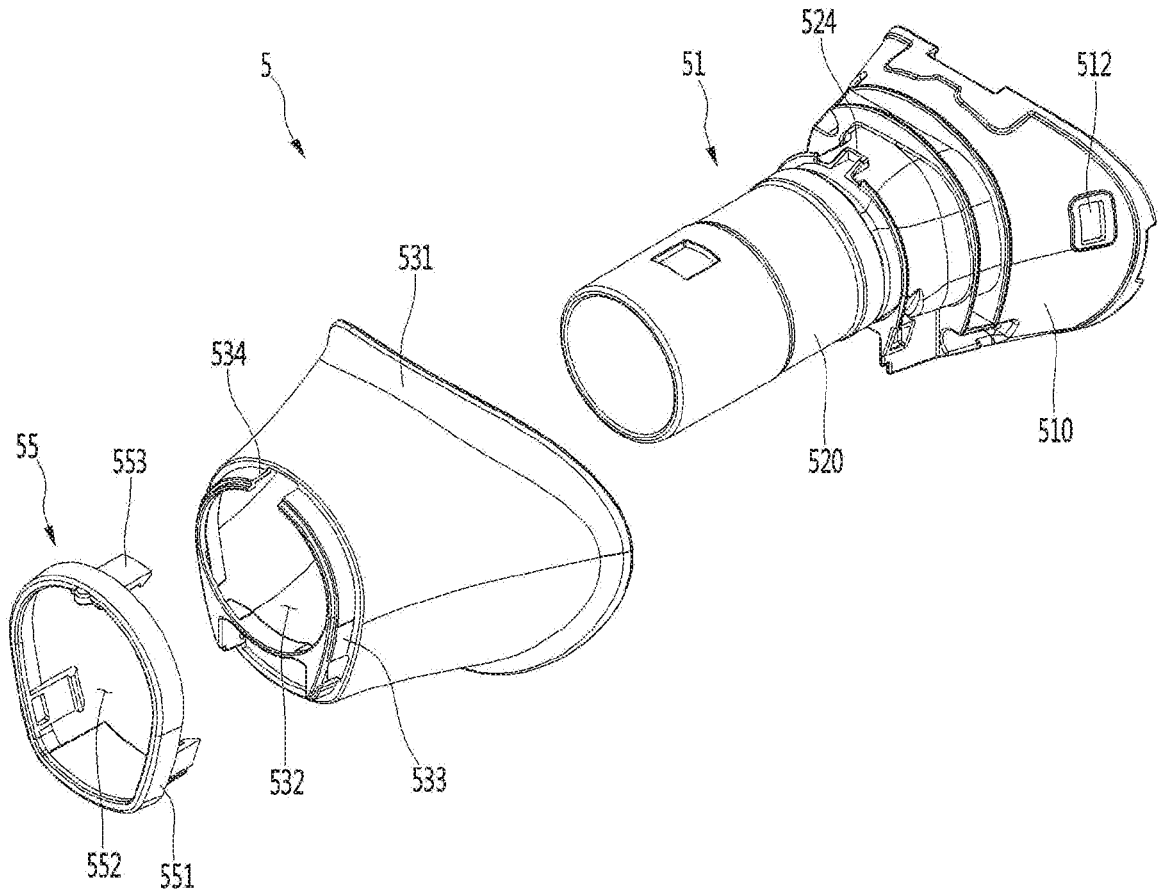
FIG. 8 is an exploded perspective view of a suction inlet according to an embodiment of the present disclosure.
Figure 9:
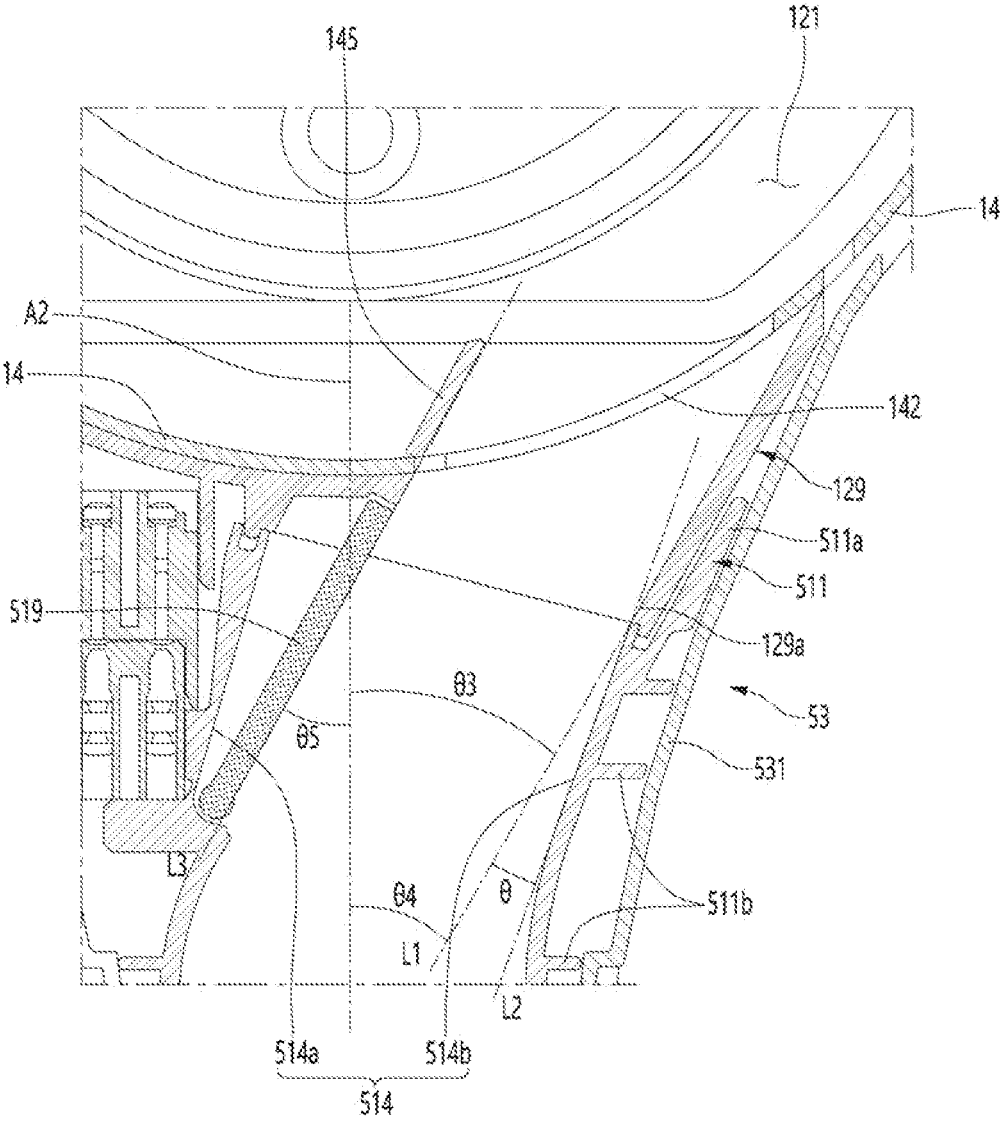
FIG. 9 is a partially enlarged view of a suction inlet and a main body in a transverse sectional view of a cleaner according to an embodiment of the present disclosure.

FIG. 7 is a perspective view of a suction inlet according to an embodiment of the present disclosure, and FIG. 8 is an exploded perspective view of a suction inlet according to an embodiment of the present disclosure. FIG. 9 is a partially enlarged view of a suction inlet and a main body in a transverse sectional view of a cleaner according to an embodiment of the present disclosure.

Referring to FIGS. 7 to 9, the connection pipe 51 may include a main body connecting portion 510 for connection to the main body 2. In addition, the connection pipe 51 may further include a guide pipe 520 extending from the main body connecting portion 510 and guiding air to the main body 2.

In this drawing, although not shown in the guide pipe 520, an extension pipe connected to a suction nozzle may be coupled thereto. Alternatively, the suction nozzle may be directly coupled to the guide pipe 520.

The main body connecting portion 510 communicates with the guide pipe 520 and may include a guide duct 514 for air flow. An edge of the guide duct 514 may be provided with an insertion groove 515 through which an end of a suction guide 129 provided in the main body 2 is inserted.

The suction guide 129 may protrude from the second body 12. In addition, air may flow smoothly between the main body 2 and the suction inlet 5 by inserting the suction guide 129 into the insertion groove 515.

A flap 519 that guides intake air to the opening 142 of the support body 14 may be provided inside the guide duct 514. For example, the flap 519 may be rotatably provided on a first surface 514*a* of the guide duct 514.

One surface 129*a* of the suction guide 129 may be connected to a second surface 514*b* facing the first surface 514*a* in the guide duct 514.

A first extension line L1 of the one surface 129*a* of the suction guide 129 may form a first angle with a second extension line L2 of the second surface 514*b*.

The first extension line L1 may extend in a tangential direction of the first cyclone unit 110 or may be inclined at a predetermined angle with the tangent line of the first cyclone unit 110.

An extension rib 511*b* extending toward the cover body 531 of the pipe cover 53 may be provided. The extension rib 511*b* may be positioned, for example, in contact with or close to the cover body 531.

Alternatively, the second surface 514*b* is spaced apart from the cover body 531 by a set distance such that the second extension line L2 of the second surface 514*b* forms a first angle with the first extension line L1.

A portion of the second surface 514*b* close to the one surface 129*a* of the suction guide 129 is a straight line, and the other portion of on the second surface 514*b* may be rounded.

The first angle may be set in a range of 0 to 7 degrees. As the second extension line L2 of the second surface 514*b* is more parallel to the first extension line L1 of the second body 12, the bending of the flow path is reduced. Accordingly, a change in the flow direction of air flowing into the first cyclone 110 is reduced, and thus there is an advantage in that the suction performance is improved.

In the present embodiment, the length of the rib 511 may be determined such that the second extension line L2 of the second surface 514*b* forms a first angle with the first extension line L1.

The third extension line L3 of the flap 519 may form a second angle with the first extension line L1.

The second angle may be equal to or smaller than the first angle.

For example, the third extension line L3 of the flap 519 may be parallel to the first extension line L1.

The guide duct 514 may further include a fixed rib 511 that is inserted and fixed to the suction guide 129 and the cover body 531. As the fixed rib 511 is inserted into the suction guide 129 and the cover body 531, the suction inlet 5 may be fixed to the main body 2.

The fixed rib 511 may include a reinforcing rib 511*a* protruding toward the cover body 531. The connection pipe 51 may be stably fixed between the suction guide 129 and the pipe cover 53 due to the reinforcing rib 511*a*.

The main body connecting portion 510 may be provided with a terminal installation portion 517 in which a terminal (not shown) for electrical connection with the main body 2 is installed.

In addition, the main body connecting portion 510 may further include a pipe fastening boss 516 for fastening to main body fastening bosses (not shown) of the bodies 10 and 12 by fastening members.

The main body connecting portion 510 may further include an engaging hole 512 in which an engaging protrusion (not shown) formed to protrude from the suction guide 129 is caught.

In order to connect the connection pipe 51 to the main body 2, first, the engaging protrusion is caught in the engaging hole 512 of the main body connecting portion 510. Then, the suction guide 129 is inserted into the insertion groove 515 of the guide duct 514, and the main body fastening boss and the pipe fastening boss 516 may be aligned. In this state, when the fastening member is fastened to the pipe fastening boss 516 and the main body fastening boss in front of the connection pipe 51, the connection pipe 51 may be fixed to the main body 2.

The connection pipe 51 is provided with an interference prevention groove 518 to prevent interference between the connection pipe 51 and the sealing member 15 when the connection pipe 51 is fixed to the main body 2.

The pipe cover 53 may cover the connection pipe 51 when the connection pipe 51 is coupled to the main body 2.

The pipe cover 53 may be provided with a through hole 531 through which the guide pipe 520 passes. In the pipe cover 53, an installation portion 532 in which the cover deco member 55 is installed may be provided around the through hole 531. In addition, a slot 534 through which a hook 553 provided in the cover deco member 55 passes may be formed in the installation portion 532.

The cover deco member 55 may include a body 551 having a through hole 552 through which the guide pipe 520 passes, and a hook 553 extending from the body 551. When the cover deco member 55 is seated on the installation portion 532 in a state the pipe cover 53 covers the connection pipe 51, the hook 553 of the cover deco member 55 is caught in a hook engaging protrusion 524 provided in the guide pipe 520 by passing through the slot 534 of the pipe cover 53.

When the cover deco member 55 is coupled to the connection pipe 51, the edges of the pipe cover 53 may contact the end of a depression formed in the first body 10.

In the state where the pipe cover 53 covers the connection pipe 51, the first member 151 of the sealing member 15 is exposed to the outside, and the second member 152 is prevented from being exposed to the outside.

Guide Member for Guiding Flow of Air Introduced Through the Suction Inlet

Figure 10:
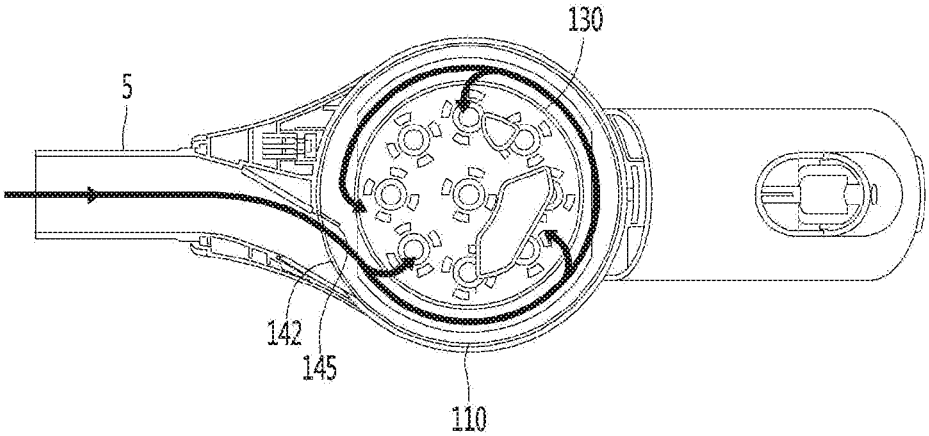
FIG. 10 is a transverse sectional view of a cleaner showing the flow of air according to an embodiment of the present disclosure.

FIG. 10 is a transverse sectional view of a cleaner showing the flow of air according to an embodiment of the present disclosure.

Referring to FIGS. 9 and 10, the first cyclone unit 110 may be provided with a guide member 145 for guiding the flow of suctioned air.

The guide member 145 may extend, for example, from the inside of the support body 14.

In addition, the height of the guide member 145 may be equal to the height of the flap 519.

The guide member 145 may be disposed in, for example, a direction parallel to the extension line L3 of the flap 519.

Alternatively, the extension line L3 of the flap 519 may be positioned on the same line as the extension line of the flap 519.

The air guided by the flap 519 and the second surface 514*b* may be guided by the guide member 145 and flow into the first cyclone unit 110. In this case, since the guide member 145 is positioned on the same line as the extension line L3 of the flap 519, a change in the flow direction of air may be small.

That is, the bending of the air flow path formed between the suction inlet 5 and the first cyclone unit 110 may be reduced. Therefore, the change in the flow direction of the air flowing into the first cyclone unit 110 is reduced, so there is an advantage that the loss of the suction force is reduced. That is, the suction performance of the cleaner 1 can be improved.

In addition, air and foreign substances suctioned through the suction inlet 5 by the operation of the suction motor 20 may be separated from each other while flowing along the inner circumferential surface of the first cyclone unit 110. In this case, foreign substances flowing along the inner circumferential surface of the first cyclone unit 110 may flow into the first cyclone unit 110 by the guide member 145.

Therefore, the foreign substances flowing through the first cyclone unit 110 and the foreign substances suctioned through the suction inlet 5 may be prevented from colliding with each other around the opening 142 by the guide member 145. Accordingly, the phenomenon that the suction flow path is blocked by foreign substances may be reduced.

What is claimed is:

1. A cleaner comprising:

a main body configured to separate dust from air suctioned through an opening;

a suction motor provided in the main body to generate a suction force; and a suction inlet including a connection pipe coupled to the opening to guide air to the main body, wherein the main body includes a suction guide protruded from the main body and coupled to one side of the connection pipe to guide air suctioned through the connection pipe to an inner circumferential surface of the main body, wherein the connection pipe includes a guide pipe having a longitudinal axis extended in a horizontal direction and a guide duct on which a rotatable flap is installed and extended from the guide pipe in the horizontal direction, wherein an end of the suction guide is in contact with the guide duct in a state in which the connection pipe is connected to the main body, wherein the guide duct includes:

a first surface on which the flap is installed, and a second surface facing the first surface, wherein a second extension line of the second surface forms a first angle with a first extension line of one surface of the suction guide connected to the second surface, wherein the first extension line is parallel to the one surface of the suction guide, wherein a third extension line of the flap and the first extension line form a second angle, wherein the second angle is equal to or smaller than the first angle, and wherein the longitudinal axis of the guide pipe passes through the flap.

2. The cleaner of claim 1, wherein the main body includes a cyclone unit that separates dust from air using a cyclone flow, and wherein the first extension line extends in a tangential direction of the cyclone unit.

3. The cleaner of claim 1, wherein the first angle is within a range of 0 degrees to 7 degrees.

4. The cleaner of claim 1, wherein a portion of the second surface close to one surface of the suction guide is straight, and the other portion of the second surface is rounded.

5. The cleaner of claim 1, further comprising a handle unit having a handle, wherein the longitudinal axis of the guide pipe passes through the handle.

6. The cleaner of claim 1, further comprising:

a guide member provided in the main body to guide air introduced through the opening.

7. The cleaner of claim 6, wherein the guide member is positioned on the third extension line of the flap.

8. The cleaner of claim 6, wherein the guide member extends parallel to the third extension line of the flap.

9. The cleaner of claim 1, wherein the suction inlet includes a pipe cover surrounding the connection pipe, and wherein the guide duct includes a rib positioned between the one surface of the suction guide and the pipe cover.

10. The cleaner of claim 9, wherein the rib includes a fixed rib protruding toward the pipe cover to contact the pipe cover.

11. The cleaner of claim 9, further comprising:

an extension rib protruding from the second surface of the guide duct toward the pipe cover.

12. The cleaner of claim 1, wherein the connection pipe includes a main body connecting portion for connection to the main body, and the guide pipe is extended from the main body connecting portion and guiding air to the main body, and wherein the guide duct is provided in the main body connecting portion.

13. The cleaner of claim 12, wherein the second extension line forms a third angle with a longitudinal axis of the guide pipe, and wherein the third angle is greater than the first angle.

14. The cleaner of claim 13, wherein the third extension line forms a fifth angle with the longitudinal axis of the guide pipe, and wherein the fifth angle is greater than the first angle and the second angle.

15. The cleaner of claim 13, wherein the first extension line forms a fourth angle with the longitudinal axis of the guide pipe, and wherein the fourth angle is greater than the third angle.

16. The cleaner of claim 15, wherein the third extension line forms a fifth angle with the longitudinal axis of the guide pipe, and wherein the fifth angle is greater than the third angle and the fourth angle.

* * * * *